US010240833B2

(12) United States Patent
Lim et al.

(10) Patent No.: US 10,240,833 B2
(45) Date of Patent: Mar. 26, 2019

(54) OIL SEPARATOR HAVING NANOROD SURFACE LAYER INSIDE

(71) Applicant: KOOKMIN UNIVERSITY INDUSTRY ACADEMY COOPERATION FOUNDATION, Seoul (KR)

(72) Inventors: Sihyung Lim, Seoul (KR); Joon Ahn, Seoul (KR); Barthwal Sumit, Seoul (KR)

(73) Assignee: KOOKMIN UNIVERSITY INDUSTRY ACADEMY COOPERATION FOUNDATION, Seoul (KR)

( * ) Notice: Subject to any disclaimer, the term of this patent is extended or adjusted under 35 U.S.C. 154(b) by 226 days.

(21) Appl. No.: 15/472,747

(22) Filed: Mar. 29, 2017

(65) Prior Publication Data

US 2017/0282112 A1 Oct. 5, 2017

(30) Foreign Application Priority Data

Mar. 29, 2016 (KR) ..... 10-2016-0037867
May 26, 2016 (KR) ..... 10-2016-0064905

(51) Int. Cl.

| | |
|---|---|
| ***B01D 53/02*** | (2006.01) |
| ***F25B 43/02*** | (2006.01) |
| ***C23C 18/12*** | (2006.01) |
| ***C23C 18/04*** | (2006.01) |

(52) U.S. Cl.

CPC ..... *F25B 43/02* (2013.01); *C23C 18/04* (2013.01); *C23C 18/1216* (2013.01); *C23C 18/1241* (2013.01); *F25B 2400/02* (2013.01)

(58) Field of Classification Search

CPC . C23C 18/04; C23C 18/1216; C23C 18/1424; F25B 2400/02; F25B 43/02

See application file for complete search history.

(56) References Cited

U.S. PATENT DOCUMENTS

| | | | | |
|---|---|---|---|---|
| 5,113,671 | A | 5/1992 | Westermeyer | |
| 8,147,599 | B2 * | 4/2012 | McAlister | F17C 11/005 206/0.7 |
| 9,682,346 | B1 * | 6/2017 | Dutta | B01D 71/024 |

(Continued)

FOREIGN PATENT DOCUMENTS

| | | |
|---|---|---|
| KR | 10-0139067 B1 | 2/1998 |
| KR | 20110037910 A | 4/2011 |

OTHER PUBLICATIONS

Hong Li, et al; "ZnO nanorod array-coated mesh film for the separation of water and oil", Nanoscale Research Letters, Dec. 2013, 6 pages.

(Continued)

*Primary Examiner* — Christopher P Jones
(74) *Attorney, Agent, or Firm* — Ladas & Parry LLP

(57) ABSTRACT

An oil separator is provided. The oil separator includes a housing providing an oil separation space therein. An inlet introducing oil/gas mixture into the oil separation space is provided within an upper portion of the housing. An outlet discharging oil is provided within the lower portion of the housing. A gas discharge conduit is connected to the oil separation space. A portion of a surface exposed in the oil separation space is provided with a nanorod layer.

13 Claims, 7 Drawing Sheets

(56) References Cited

U.S. PATENT DOCUMENTS

| | | | | |
|---|---|---|---|---|
| 2010/0186805 | A1* | 7/2010 | Krunks | H01L 31/02242 136/255 |
| 2011/0082105 | A1 | 4/2011 | Fevola et al. | |
| 2011/0226697 | A1* | 9/2011 | McLellan | B01D 53/62 210/651 |

OTHER PUBLICATIONS

Oleg Lupan, et al; "Synthesis and Characterization of Ag- or Sb-Doped ZnO Nanorods by a Facile Hydrothermal Route", J. Phys. Chem. C2010, 114, 12401-12408: Published on Web Jul. 1, 2010.

* cited by examiner

OIL SEPARATOR HAVING NANOROD SURFACE LAYER INSIDE

CROSS-REFERENCE TO RELATED APPLICATION

This application claims priority to and the benefit of Korean Patent Applications No. 2016-0037867, filed on Mar. 29, 2016 and No. 2016-0064905, May 26, 2016 the disclosure of which is incorporated herein by reference in its entirety.

BACKGROUND

1. Field of the Invention

The present invention relates to a field of an oil separator.

2. Discussion of Related Art

Refrigeration systems utilize a compressor to compress a refrigerant gas, a condenser to cool the compressed gas and to cause the gas to be condensed to a liquid, and an evaporator for absorbing heat from the area to be refrigerated as the liquid refrigerant expands and evaporates. In many such systems, oil is used as a lubricant and to provide a more effective seal in the compressor and, by such use, is mixed with the refrigerant gas in the compressor and is carried along with the refrigerant. Oil, however, is not a refrigerant and therefore it reduces the efficiency of the system if the oil is permitted to remain mixed with the refrigerant gas as it moves to the condenser. Therefore, it is known to provide an oil separator in the line between the compressor and condenser to remove the oil from the refrigerant gas.

U.S. Pat. No. 5,404,730 discloses an oil separator including a housing, an oil/gas inlet into the housing, a gas outlet through the housing having a peripheral wall and a bottom wall, a helical wall formed within the housing, an oil collection zone arranged below the helical wall, and an oil outlet arranged through the housing in the oil collection zone. The oil separator further comprises a steel mesh screen on the interior of the peripheral wall.

SUMMARY OF THE INVENTION

According to an aspect of the present invention, there is provided an oil separator. The oil separator comprises a housing providing an oil separation space therein; an inlet introducing oil/gas mixture into the oil separation space and provided within an upper portion of the housing; an outlet discharging oil and provided within the lower portion of the housing; and a gas discharge conduit connected to the oil separation space. A portion of a surface exposed in the oil separation space is provided with a nanorod layer.

The surface provided with the nanorod layer may be a surface of steel substrate. The steel substrate may be a SS-400 substrate.

The nanorod layer may be a transition-metal-doped ZnO nanorod layer. The transition-metal-doped ZnO nanorod layer may be a Ag-doped ZnO nanorod layer, a Au-doped ZnO nanorod layer, or a Ni-doped ZnO nanorod layer. The transition-metal-doped ZnO nanorod layer may have a plurality of nanorods less than about 1.5 μm in length with an average diameter of about 100 to 500 nm. The transition-metal-doped ZnO nanorod layer may have a plurality of nanorods, the plurality of nanorods is combined to form a plurality of bundles of nanorods, and the plurality of the bundles is arranged so as to expand toward upper direction from the surface.

The nanorod layer may have superamphiphilic characteristics.

The housing may have a cylindrical body providing a cylindrical inner wall exposed to the oil separation space, and the nanorod layer may be provided on the cylindrical inner wall. The cylindrical body may be made of SS-400. The gas discharge conduit my extend inside the housing, and a helical-type plate member may be provided on the outer surface of the conduit. The nanorod layer may be provided on at least one of a surface of the helical type plate member exposed to the oil separation space and an outer surface of the gas discharge conduit exposed to the oil separation space. The helical type plate member and the gas discharge conduit may be made of SS-400.

BRIEF DESCRIPTION OF THE DRAWINGS

The above and other subjects, features, and advantages of the present invention will become more apparent to those of ordinary skill in the art by describing in detail exemplary embodiments thereof with reference to the accompanying drawings, in which.

Figure 5:
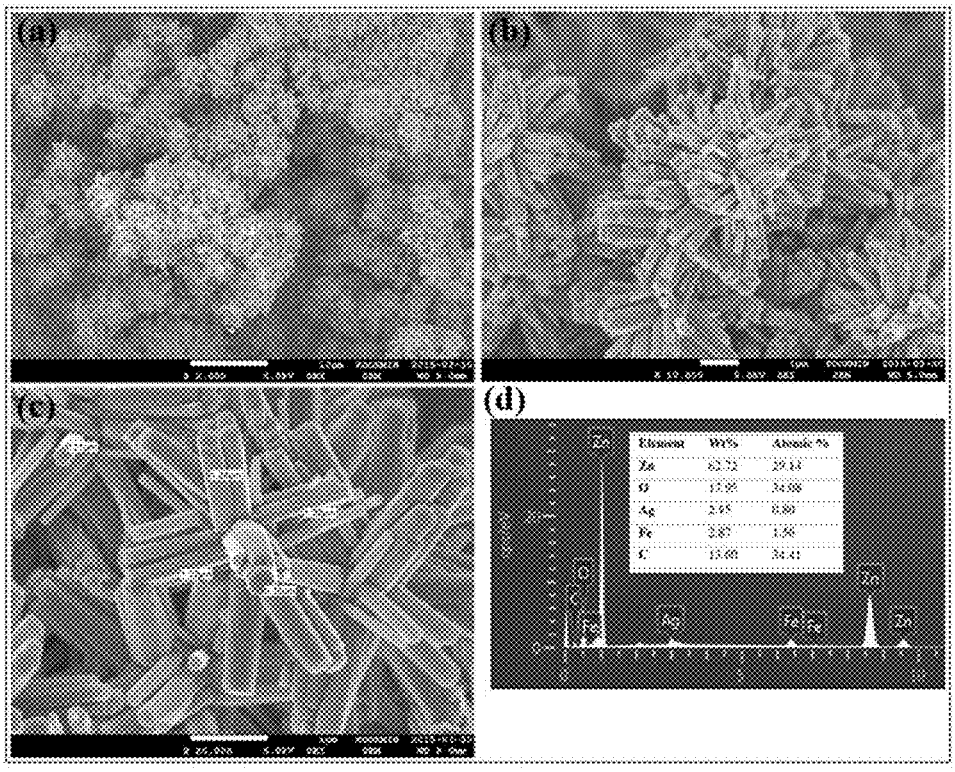
Figure 6:
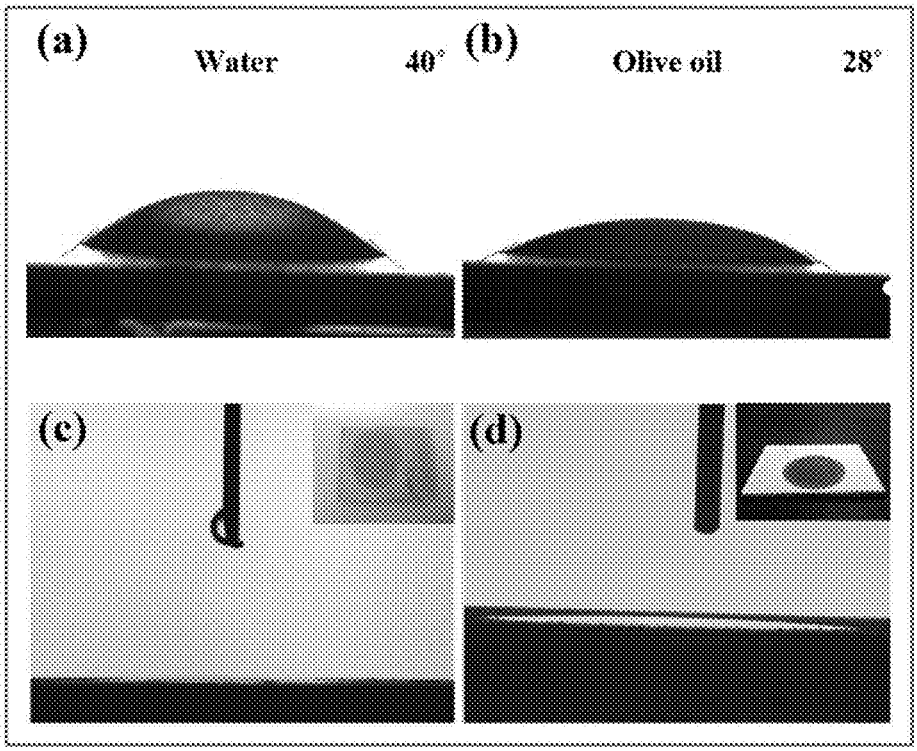
Figure 7:
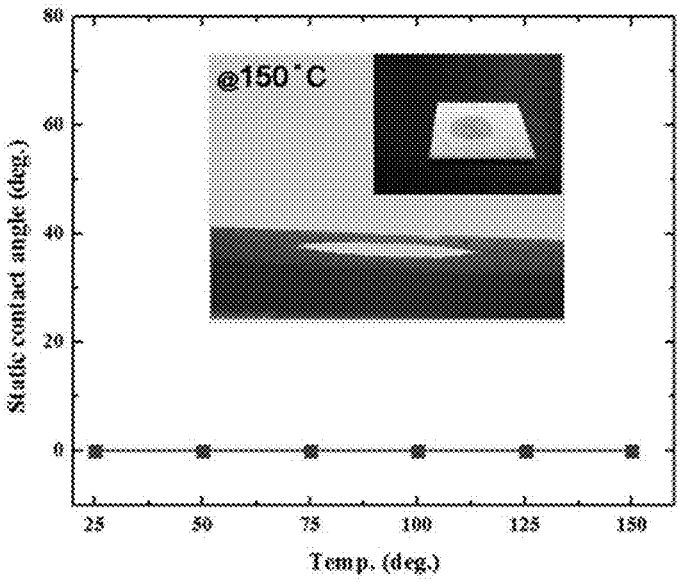
Figure 8:
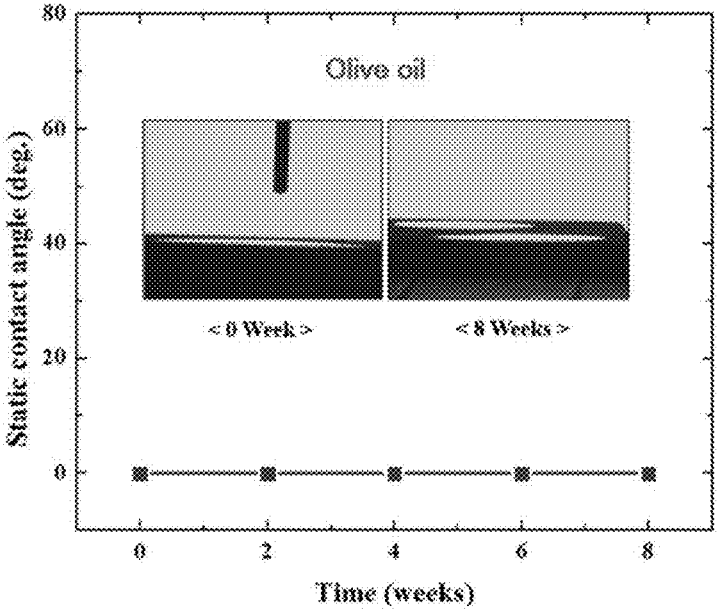
Figure 9:
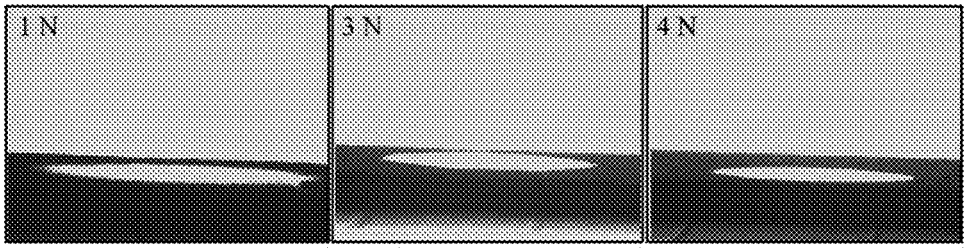
Figure 10:
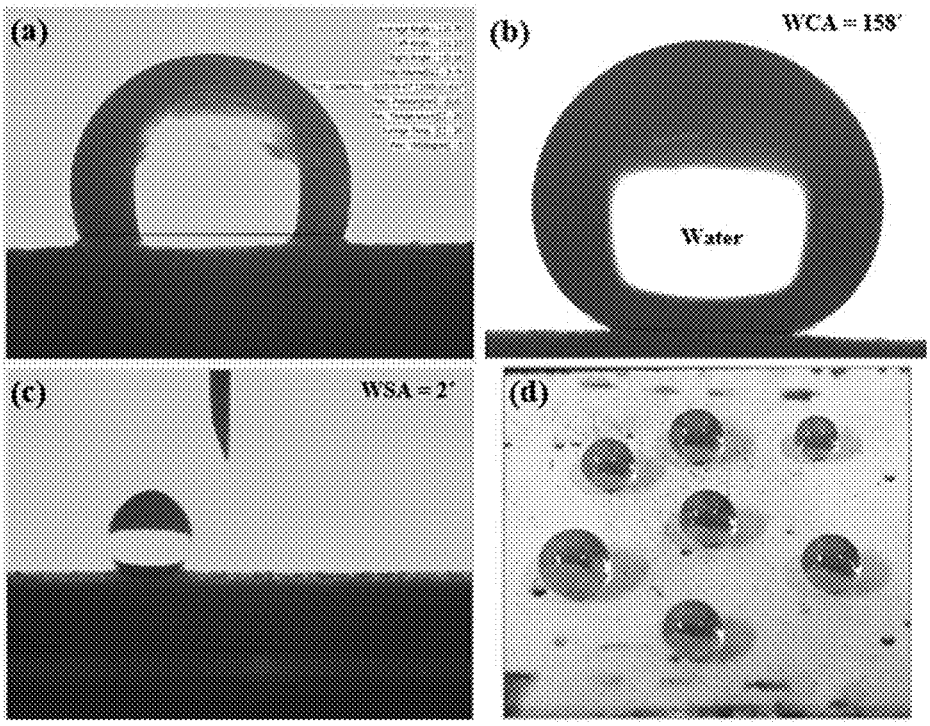
Figure 11:
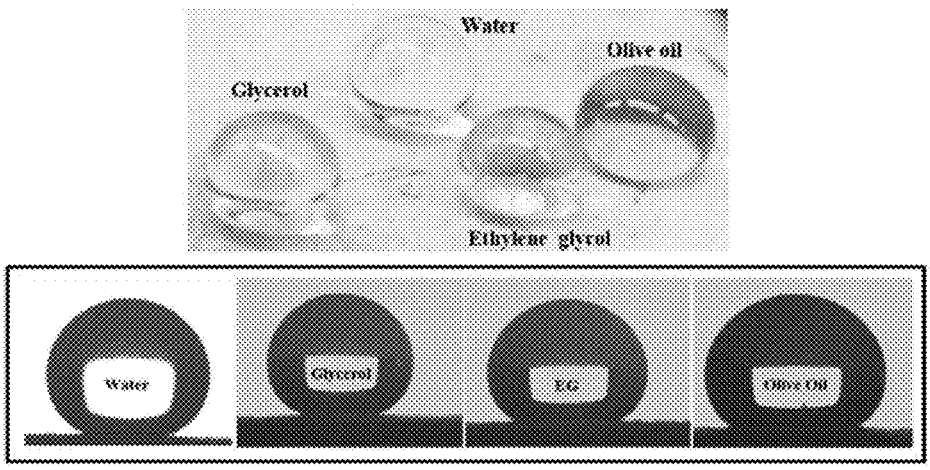
Figure 12:
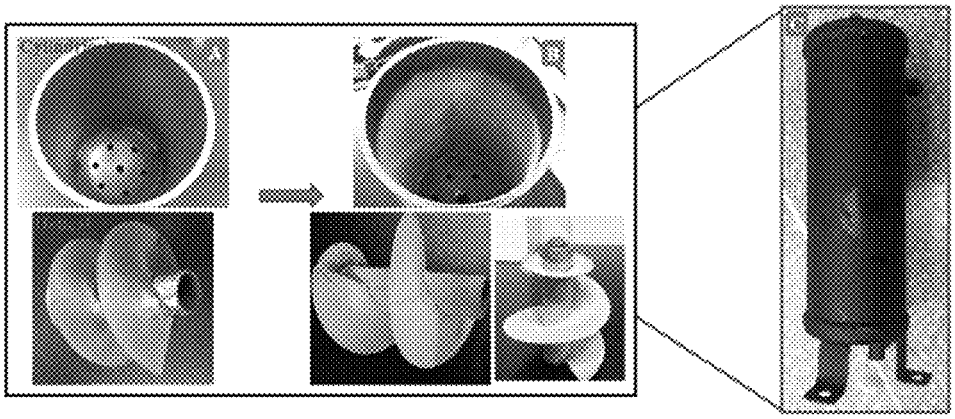
Figure 13:
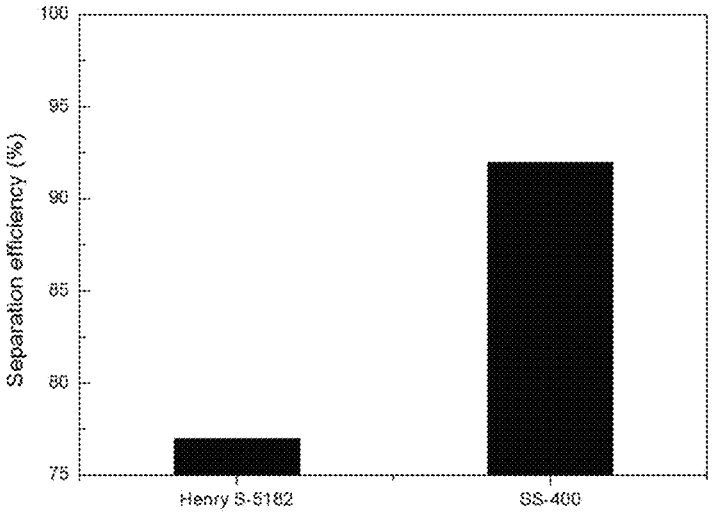

FIG. **4*a*** is a photo showing the surface condition of the substrates according to Fabrication Example and Comparative Example;

FIG. **4*b*** is a photo showing the surface condition of the substrates according to Fabrication Example and Comparative Example after finger touching on the surfaces of the substrates;

FIG. 5 shows SEM images of the Ag-doped ZnO nanorods observed at (a) low and (b-c) high magnification, and (d) EDX spectrum;

FIG. 6 has photos showing contact angle profile of untreated bare SS-400 surface with (a) water and (b) olive oil and SS-400 surface modified with Ag-doped ZnO nanorods with (c) water and (d) olive oil;

FIG. 7 is a graph showing a relationship between temperature and olive oil CA on Ag-doped ZnO nanorods on an SS-400 substrate fabricated according to the Fabrication Example;

FIG. 8 is a graph showing a relationship between the exposure time and olive oil CA on Ag-doped ZnO nanorods on an SS-400 substrate fabricated according to the Fabrication Example;

FIG. 9 shows photos indicating contact angle of olive oil on the fabricated Ag-doped ZnO nanorod surface on SS-400 substrate after applying different forces;

FIG. 10 shows photographs indicating (a) contact angle profile of water on bare surface of SS-400 substrate after modification with stearic acid; and (b) contact angle profile of water, (c) sliding angle profile of water, and (d) water droplets on Ag-doped ZnO nanorods on an SS-400 substrate fabricated according to Fabrication Example after treatment with stearic acid;

FIG. 11 shows a photograph and cross-sectional views of different liquid droplets on the fabricated SS-400 substrate having Ag-doped ZnO nanorods thereon and modified with stearic acid;

FIG. 12 shows photographs of helical-type oil separator consisting of cylindrical container and helical body parts made of SS-400, (A) before treatment, (B) after treatment according to the Fabrication Example; and (c) in assembled state; and FIG. 13 shows comparison of oil separation efficiency and pressure drop between a commercial oil separator and the oil separator made of SS-400 material with Ag-doped ZnO nanorods on the surfaces according to the Fabrication Example.

DETAILED DESCRIPTION OF EXEMPLARY EMBODIMENTS

Exemplary embodiments of the present invention will be described in detail below with reference to the accompanying drawings. However, since the present invention is not limited to the embodiments disclosed hereinafter, the embodiments of the present invention can be implemented in various forms. It will be understood that when a layer is referred to as being "on" another layer or a substrate, the layer may be formed directly on the other layer or the substrate, or an intervening layer may exist between the layer and the other layer or the substrate.

The present invention is not limited to the exemplary embodiments and the accompanying drawings disclosed, and only defined by the scope of the appended claims. Accordingly, it will be apparent to those skilled in the art that various modifications, equivalents, and alternatives can be made to the described exemplary embodiments of the present invention without departing from the spirit or scope of the invention, and it is intended that the present invention is to cover all such modifications, equivalents, and alternatives. The same reference numbers will be used throughout this specification to refer to the same or like components.

Spatially relative terms, such as "upper portion," "lower portion," "upper surface," "lower surface," and the like may be described as illustrated in the drawings, unless described otherwise. In illustrating a layered structure in the accompanying drawings, a portion closer to a display surface on which an image is displayed is illustrated to be disposed at an upper side, and a portion opposite thereto is illustrated to be disposed at a lower side.

It will be understood that, although the terms "first," "second," "A," "B," etc. may be used herein to describe various elements, these elements should not be limited by these terms. These terms are only used to distinguish one element from another. Therefore, a first element, a first component, or a first section could be termed a second element, a second component, or a second section within the scope of the invention. The term "and/or" includes any and all combinations of one or more referents.

It will be understood that when an element or layer is referred to as being "connected to" or "coupled to" another element or layer, it can be connected or coupled to the other element or layer or intervening elements or layers may be present. In contrast, when an element is referred to as "directly connected to" or "directly coupled to" another element or layer, there are no intervening elements or layers present.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
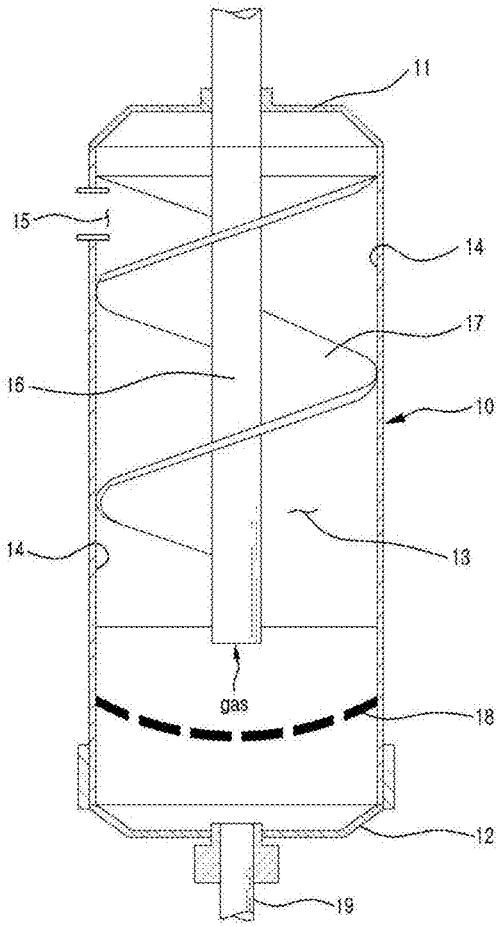
FIG. 1 is a cross-sectional view schematically showing an oil separator according to an embodiment of the present invention.

FIG. 1 is a cross-sectional view schematically showing an oil separator according to an embodiment of the present invention.

Referring to FIG. 1, the oil separator may include a housing 10 which provides an oil separation space 13 therein. The housing 10 may have a cylindrical body providing a cylindrical inner wall 14. The housing 10 may further have an upper cap 11 and a lower cap 12 that are disposed at the top and bottom of the body, respectively. An inlet 15 is provided within an upper portion of the housing 10. The inlet 15 may be provided at an upper portion of the housing 10, specifically at an upper portion of the body. The inlet 15 may orient toward the central axis of the cylindrical body or toward the edge of the cylindrical body. Through the inlet 15, a mixture of oil and non-oil gas, i.e., oil/gas mixture may be introduced. The oil may be in a form of fog, and the non-oil gas may be refrigerant. Thus, through the inlet 15, the oil fog carrying the refrigerant may be introduced to the oil separation space 13.

The oil separation space 13 may be connected to a gas discharge conduit 16. Specifically, the gas discharge conduit 16 may extend inside the housing 10, for example extend along the axis of the housing 10. A lower end of the gas discharge conduit 16 may face the lower cap 12 inside the housing 10 and an upper end of the gas discharge conduit 16 may protrude through the housing 10 for example, the upper cap 11. A helical-type plate member 17 may be provided on an outer surface of the conduit 16. In the oil separation space 13, a baffle plate 18 having a plurality of openings may be disposed. Specifically, the baffle plate 18 may be disposed between the lower end of the gas discharge conduit 16 and the lower cap 12. An outlet 19 is provided within a lower portion of the housing 10. Specifically, the outlet 19 may be provided in the lower cap 12.

When the oil/gas mixture contacts with the surfaces exposed in the oil separation space 13, the oil may be separated and collected from the mixture in the oil separation space 13. The surfaces contacting with the mixture may be anyone of the cylindrical inner wall 14, a surface of the helical type plate member 17, and the outer surface of the gas discharge conduit 16. The collected oil can flow downward by gravity, pass through the openings in the baffle 18, and then be discharged through outlet 19. The remaining gas in the oil separation space 13 can be discharged through the gas discharge conduit 16.

A nanorod layer having a plurality of nanorods may be provided on the surface for contact with the oil/gas mixture, specifically the nanorod layer may be provided on the surface exposed within oil separation space 13. The nanorod layer may be provided on anyone of the cylindrical inner wall 14, the surface of the helical type plate member 17, and the outer surface of the gas discharge conduit 16. For example, the nanorod surface layer may be provided on the cylindrical inner wall 14, the surface of the helical type plate member 17, as well as the outer surface of the gas discharge conduit 16.

The oil may be separated and collected from the oil/gas mixture on the nanorod layer more efficiently. Then, the collected oil can flow downward by gravity, pass through the openings in the baffle 18, and then be discharged through outlet 19 as described above. Specifically, when the oil/gas mixture is in contact with the nanorod layer, the oil can spread into spaces between the nanorods by the capillary effect; thus oil separation efficiency can be improved. The nanorod layer may be a transition-metal-doped ZnO nanorod layer having superamphiphilic characteristic. The transition-metal-doped ZnO nanorod surface layer having superamphiphilic characteristic may exhibit a contact angle lower than 5°, lower than 2°, close to 0°, or 0° for oil, resulting in complete spreading of oil thereon. Thus, the oil from the mixture can be further selectively collected and spread on the transition-metal-doped ZnO nanorod surface layer. As a result, the oil separator having the transition-metal-doped ZnO nanorod surface layer in contact with the oil/gas mixture can improve oil separation efficiency greatly. In addition, the surface preparation technique of the present invention can be easily applied on the surface of three-dimensional structure like curved surface, and the prepared surface layer like the transition-metal-doped ZnO nanorod surface layer can have wettability with long-term, thermal stability and mechanical stability to be applied to various fields.

The method for forming the nanorod layer is described below.

Figure 2:
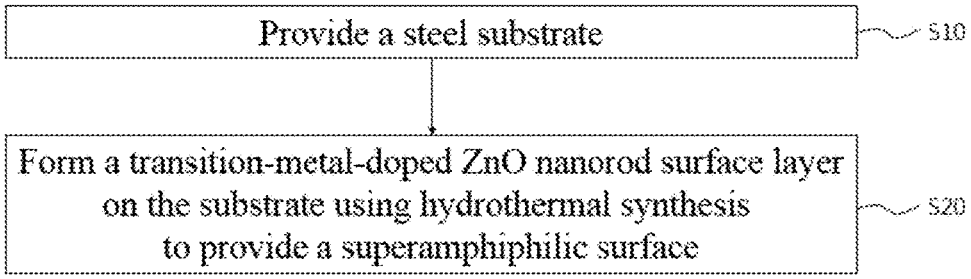
FIG. 2 is a flow chart for manufacturing a superamphiphilic surface according to an embodiment.

FIG. 2 is a flow chart for manufacturing a nanorod layer according to an embodiment.

Referring to FIG. 2, a steel substrate may be provided (S10). The substrate may be a part of a machine. In addition, the substrate may have a 3D structure for example, a curved structure such as a cylindrical or a helical structure. For example, the substrate may be a part of oil separator such as the cylindrical body of the housing 10 of FIG. 1, the helical-type plate member 17 of FIG. 1, or the gas discharge conduit 16 of FIG. 1. The steel substrate may be a structural steel substrate, for example, a SS-400 substrate. According to Japanese Industrial Standard (JIS) G 3101, in SS-400, the percentages of carbon, silicon, and manganese are not fixed, but the phosphorus and sulphur concentrations are constrained to maximum levels below 0.05%, and the remaining component is iron with negligible impurities. There may be great demand for SS-400 substrates because this material is cheap, excellent in terms of weldability and machinability, and has wide industrial applications such as ships, bridges, structural tubes, pipes, rods, and various structural sectional steels.

A nanorod layer may be formed on the substrate using hydrothermal synthesis (S20). The nanorod layer may be a transition-metal-doped ZnO nanorod layer. The transition metal may be Ag, Au, or Ni to provide Ag-doped, Au-doped, or Ni-doped ZnO nanorod surface layer, respectively. Along with heat, an aqueous solution containing zinc salt, transition metal salt, and ammonia may be applied on a surface of the substrate to grow transition-metal-doped ZnO nanorods thereon. Specifically, the substrate may be immersed in the aqueous solution, and the substrate immersed in the aqueous solution may be heated.

The zinc salt may be zinc nitrate. The transitional metal salt may be silver salt, gold salt, or nickel salt. The silver salt may be silver nitrate, the gold salt may be gold nitrate, and the nickel salt may be nickel nitrate. In the aqueous solution, the zinc salt may be present at a concentration of 0.05 to 0.15M, 0.07 to 0.13M, or 0.08 to 0.12M, and the transition metal salt may be present at a concentration of 0.001M to 0.003M, 0.0015M to 0.0025M, or 0.0018M to 0.0022M. The heat treatment temperature may be 85 to 110° C., or 90 to 105° C.

The transition-metal-doped ZnO nanorod surface layer may have a plurality of nanorods less than about 1.5 μm in length with an average diameter of about 100 to 500 nm, about 200 to 400 nm, about 250 to 350 nm, for example, 300 nm. The nanorods may be more than about 1 μm in length. Further, the plurality of transition-metal-doped ZnO nanorods may be combined to form a bundle of nanorods, and a plurality of bundles of transition-metal-doped ZnO nanorods may be arranged so as to expand toward upper direction from the surface of the substrate. In addition, at the upper end of any one bundle, another plurality of bundles of transition-metal-doped ZnO nanorods may be arranged so as to expand toward upper direction. An Example of transition-metal-doped ZnO nanorod surface layer can be shown on FIG. 5.

The transition-metal-doped ZnO nanorod surface layer may exhibit superamphiphilic characteristics. Accordingly, the present embodiment enables a surface layer having high degree of amphiphilicity to be formed using a relatively simple and economical method. The transition metal doped in the ZnO nanorod or the transition metal salt may prevent the substrate from rusting during the hydrothermal process, and therefore adhesion between transition-metal-doped ZnO nanorods and the substrate surface may be improved.

Figure 3:
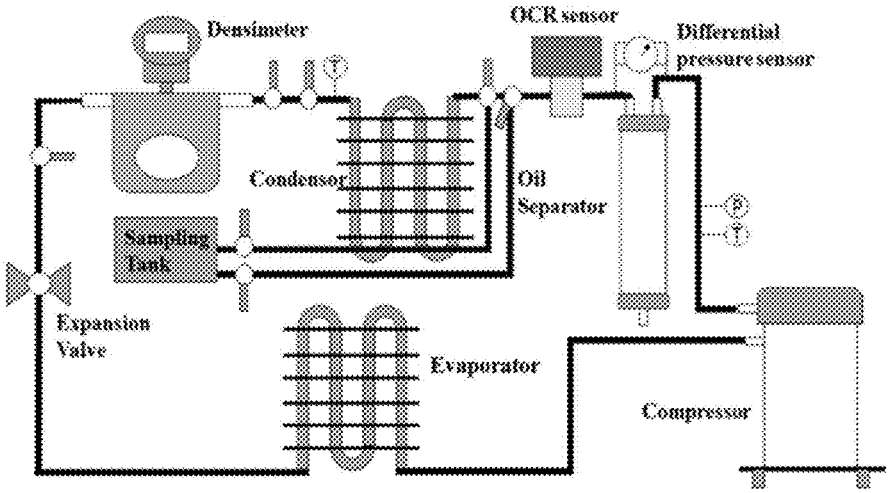
FIG. 3 is a schematic diagram showing a cooling system. The cooling system may be a refrigeration system.

FIG. 3 is a schematic diagram showing a cooling system. The cooling system may be a refrigeration system.

Referring to FIG. 3, a cooling system may have a compressor, condenser, expansion valve, and evaporator. In the system, the compressor may use lubricating oil along with refrigerant which circulates in the system. Specifically, the compressor may need the lubricating oil to improve its working efficiency. An oil separator may be installed between the compressor and condenser to separate oil from the refrigerant, which helps to maintain the compressor oil level and raises the efficiency of the system by preventing excessive oil circulation. The oil separator may have the same structure as described referring to FIG. 2.

Hereinafter, experimental examples will be provided for a better understanding of the present invention. However, the present invention should not be construed as limited to the experimental examples.

<Fabrication Example of Ag-Doped ZnO Nanorods on Ss-400 Substrate>

Zinc nitrate hexahydrate and silver nitrate were dissolved into 100 mL of deionized (DI) water to obtain solution having 0.1M zinc nitrate and 0.002M silver nitrate. An ammonia solution (29.6%) was added until the solution became transparent. SS-400 substrate was ultrasonically cleaned in acetone and deionized water (DI) for 5 min and then dried in a stream of nitrogen. The cleaned SS-400 substrate was immersed vertically into the above solution in a beaker and the beaker was placed inside a preheated oven for 1 hour at 95° C. After the reaction to form Ag-doped ZnO nanorods on the SS-400 substrate was completed, the substrate was rinsed in DI water and dried with N2 gas.

<Comparative Example of Non-Doped ZnO Nanorods on Ss-400 Substrate>

ZnO nanorods was formed on a SS-400 substrate using the same method as described in Fabrication Example, except that silver nitrate was not used.

Figure 4A:
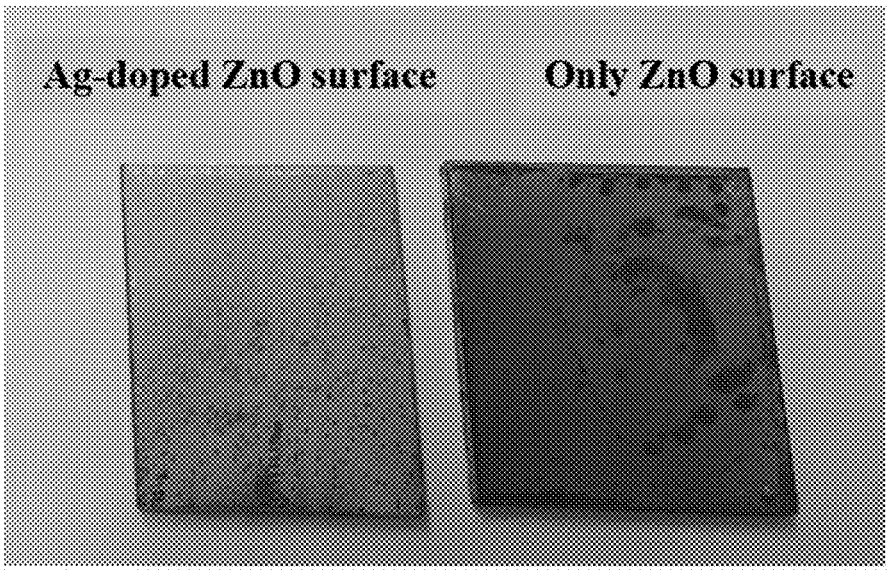
Figure 4B:
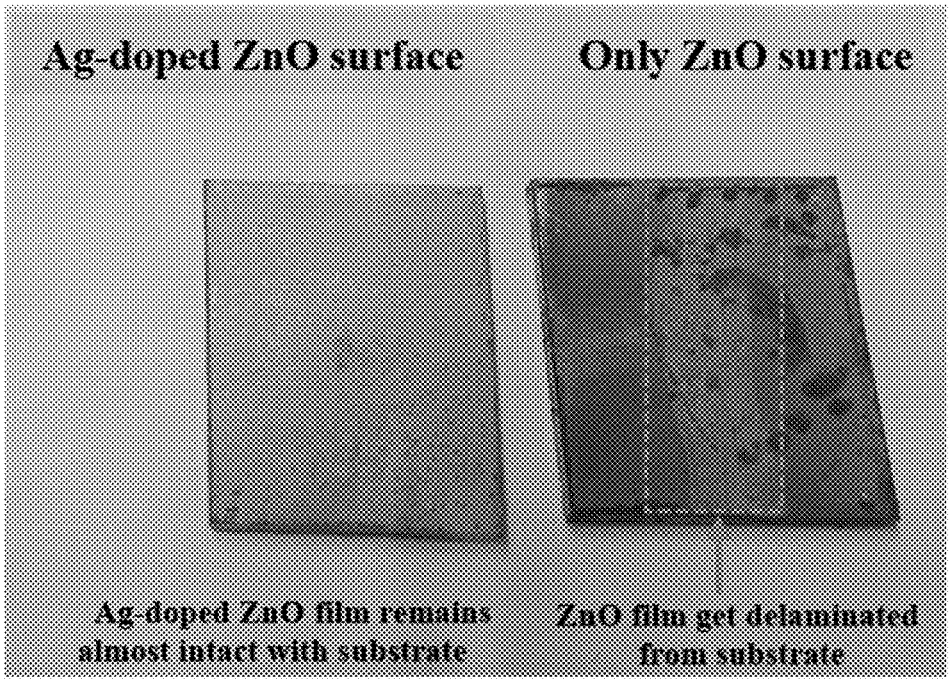

FIG. 4*a* is a photo showing the surface condition of the substrates according to Fabrication Example and Comparative Example. FIG. 4*b* is a photo showing the surface condition of the substrates according to Fabrication Example and Comparative Example after finger touching on the surfaces of the substrates.

Referring to FIG. 4*a*, the non-doped ZnO nanorods are not consistently or uniformly formed on the SS-400 substrate compared to the Ag-doped ZnO nanorods on the SS-400 substrate.

Referring to FIG. 4*b*, the non-doped ZnO nanorods are removed from the finger-touched area of the substrate. This indicates that the adhesion between non-doped ZnO nanorods and the SS-400 surface is not good. However, the Ag-doped ZnO nanorods remains almost intact even after finger-touched. This indicates that the adhesion between Ag-doped ZnO nanorods and the SS-400 surface is greatly improved compared to the non-doped ZnO nanorods on the SS-400 surface.

FIG. 5 shows SEM images of the Ag-doped ZnO nanorods observed at (a) low and (b-c) high magnification, and (d) EDX spectrum. These SEM images are obtained using field-emission scanning electron microscopy (FESEM, JEOL, JSM-740 1F, Japan).

Referring to FIG. 5, highly dense Ag-doped ZnO nanorods are grown on the SS-400 substrate. The Ag-doped ZnO nanorods are less than about 1.5 μm in length with an average diameter of 300 nm (a, b, c). Further, the plurality of Ag-doped ZnO nanorods are combined to form a bundle of nanorods, and a plurality of the bundles of Ag-doped ZnO nanorods are arranged so as to expand from below to upper direction to make flower-like structure. The flower-like structures are randomly stacked in multiple layers. The composition of the as-synthesized Ag-doped ZnO nanorods is further characterized by EDX (d) and, referring to the EDS result, all the peaks clearly imply that the as-synthesized nanorods consist of the elements Zn, Ag, and O with some additional peaks. These additional peaks belong to the SS-400 substrate.

FIG. 6 has photos showing contact angle profile of untreated bare SS-400 surface with (a) water and (b) olive oil and SS-400 surface modified with Ag-doped ZnO nanorods with (c) water and (d) olive oil. The contact angles were measured with 5 μl droplets of water and olive oil using a contact angle measurement system (Phoenix 300 Touch, SEO Co. Ltd). Optical images of the droplets were obtained using a digital camera (SONY Inc.).

Referring to FIG. 6, the wetting behavior of the as-synthesized surface can be determined by contact angle (CA) measurement. The water and olive oil CAs for a bare SS-400 surface are 40° and 28°, respectively, showing amphiphilic properties since both CAs are lower than 90°. However, after modifying the SS-400 substrate with Ag-doped ZnO nanorods, the amphiphilic property of the surface is improved, with a decrease in CAs to 0° for both water and olive oil. It can be seen that the increase in surface roughness due to Ag-doped ZnO nanorods significantly improves wettability.

In the case of the SS-400 substrate having Ag-doped ZnO nanorods thereon according to the Fabrication Example, the surface is very rough because the Ag-doped ZnO nanorods are combined and aggregate into 3D architectures. Thus, when a water or oil droplet comes into contact with such surfaces, it can be induced by the capillary effects of the three-dimensional surface shape to enter into and fill the grooves of the film, spreading instantly.

FIG. 7 is a graph showing a relationship between temperature and olive oil CA on Ag-doped ZnO nanorods on an SS-400 substrate fabricated according to the Fabrication Example. The fabricated SS-400 substrate having Ag-doped ZnO nanorods thereon was heated at different temperatures for 30 min in the ambient environment. Then, the superoleophilic property of the heated surfaces was checked by measuring the CA with olive oil. Average CA values were obtained by measuring each sample at a minimum of five different positions at room temperature.

Referring to FIG. 7, there is no evident change in the olive oil CA values on the fabricated SS-400 substrate modified with Ag-doped ZnO nanorods, and the surfaces still shows excellent superoleophilic properties. From this result, it can be seen that the surface roughness of the SS-400 substrate modified with Ag-doped ZnO nanorods is still maintained after heat treatment. Therefore, we can assume that the surface can also show excellent superhydrophilic properties along with superoleophilic properties. The superamphiphilic surfaces having thermal stability can have many practical and industrial applications.

FIG. 8 is a graph showing a relationship between the exposure time and olive oil CA on Ag-doped ZnO nanorods on an SS-400 substrate fabricated according to the Fabrication Example. The olive oil CA was measured right after the olive oil was dropped on the surface on the fabrication day and measured regularly with exposure to air for 8 weeks.

Referring to FIG. 8, even after 8 weeks, olive oil CA is not evidently changed and still less than 5°. Therefore, it can be seen that fabricated Ag-doped ZnO nanorod rough surfaces on SS-400 substrate are sufficiently stable after exposure to environmental conditions; moreover, they enable spreading of liquids easily with excellent superamphiphilic properties. Like this, these fabricated surfaces have long-term stable superamphiphilic property after prolonged exposure to the ambient environment; therefore, these fabricated superamphiphilic surfaces can be applied to real, practical applications.

FIG. 9 shows photos indicating contact angle of olive oil on the fabricated Ag-doped ZnO nanorod surface on SS-400 substrate after applying different forces. These photos were taken after each load of up to 4 N was applied for 20 min on the area of approximately 5 $cm^2$ of fabricated surfaces.

Referring to FIG. 9, Ag-doped ZnO nanorod surfaces on SS-400 substrates retain their superamphiphilic properties after applying different loads; therefore, it can be seen that the Ag-doped ZnO nanorod surfaces have superior mechanical durability.

FIG. 10 shows photographs indicating (a) contact angle profile of water on bare surface of SS-400 substrate after modification with stearic acid; and (b) contact angle profile of water, (c) sliding angle profile of water, and (d) water droplets on Ag-doped ZnO nanorods on an SS-400 substrate fabricated according to Fabrication Example after treatment with stearic acid. Bare SS-400 substrate and the SS-400 substrate having Ag-doped ZnO nanorods thereon fabricated according to Fabrication Example were immersed in the stearic acid solution including 5 mM of stearic acid in ethanol at room temperature for 20 min and then heated on a hot plate at 80° C. for 1 hour to generate superhydrophobic surfaces.

Referring to FIG. 10, after coating with stearic acid, the apparent contact angles of the untreated bare SS-400 and Ag-doped ZnO nanorods fabricated on SS-400 substrates are 111° and 158°, respectively. In addition to large CAs, the Ag-doped ZnO nanorods fabricated on SS-400 substrates also showed a low sliding angle (SA) of 2° and water droplets easily rolled off the substrate, as shown in (c) and (d).

FIG. 11 shows a photograph and cross-sectional views of different liquid droplets on the fabricated SS-400 substrate having Ag-doped ZnO nanorods thereon and modified with stearic acid. Table 1 shows surface contact angles and sliding angles (SAs) of various liquids of different surface tensions on the fabricated SS-400 substrates having Ag-doped ZnO nanorods thereon and modified with stearic acid.

TABLE 1

| Liquid | Surface Tension (mN/m) (20° C.) | Surface Contact Angle (deg.) | Sliding Angle (SA) (deg.) |
|---|---|---|---|
| Water | 72.0 | 158 | 2 |
| Glycerol | 63.6 | 156 | 3 |
| Ethylene glycol | 48.0 | 145 | 14 |
| Olive oil | 32.0 | 142 | no sliding |

Referring to FIG. 11 and Table 1, the CAs for water, glycerol, ethylene glycol, and olive oil are 158°, 156°, 145°, and 142°, respectively. Thus, it can be seen that by altering the surface energy of the textured surface with a low-surface-energy material, superhydrophilic (or superamphiphilic) surfaces can be easily transformed into superhydrophobic or oleophobic (superamphiphobic) surfaces.

FIG. 12 shows photographs of helical-type oil separator consisting of cylindrical container and helical body parts made of SS-400, (A) before treatment, (B) after treatment according to the Fabrication Example; and (c) in assembled state. The Oil separator consists of the cylindrical container and the helical body part whose lengths were 34 cm and 18.2 cm, respectively. The inner wall of the cylindrical container and outer surfaces of the helical body part were treated with the method according to the Fabrication Example to create superamphiphilic surfaces.

Referring to FIG. 12, the oil separator made of SS-400 material is shown before and after Ag-doped ZnO nanorods are formed on the surfaces according to the Fabrication Example. It is clear that the uniform layer of Ag-doped ZnO nanorods is fabricated on the inner walls of the oil separator, i.e., inner wall of the cylindrical container and outer surfaces of the helical body part.

FIG. 13 shows comparison of oil separation efficiency and pressure drop between a commercial oil separator (Henry S-5182) and the oil separator made of SS-400 material with Ag-doped ZnO nanorods on the surfaces according to the Fabrication Example. Oil separation efficiency is defined as the ratio of separated oil to the mixture of oil and refrigerant discharged from a compressor. As compressed air passed through the oil mist generator, it was sprayed with oil particles and passed through the oil separator. The oil particles were trapped in the container at the bottom of the fabricated superamphiphilic oil separator, and the air was released from the oil separator. The ratio of the amount of collected oil to the amount of sprayed oil was calculated and the separation efficiency was measured. Similarly, the pressure drop of the oil separator was measured by differential pressure gauges installed in the inlet and outlet of the oil separator.

Referring to FIG. 13, the oil separator equipped with the superamphiphilic SS-400 surface shows better oil separation efficiency by up to 91.2% with a lower pressure drop compared with the commercial version. Thus, it can be seen that our simple method can be implemented easily for fabricating superamphiphilic surfaces which can be applied to large-scale processes and applications.

A cost-effective and time-saving method is disclosed to fabricate superamphiphilic surfaces on steel surfaces for example, SS-400 substrates. Transition-metal-doped for example Ag-doped ZnO nanorods were synthesized using a hydrothermal technique to create these surfaces. The fabricated surfaces show excellent superamphiphilic properties with water and oil owing to enhanced surface roughness and complete spreading of liquids to near-zero contact angles. Furthermore, the fabricated Ag-doped ZnO nanorod surfaces showed excellent superamphiphilic properties that were stable under long-term storage, thermal, and mechanical tests. After coating with a low-surface-energy material, the fabricated superamphiphilic surfaces can easily be converted into superhydrophobic/oleophobic surfaces. Finally, the fabrication method applied to a helical-type oil separator made of SS-400 material provides that the fabrication technique developed can be useful in achieving superamphiphilic properties on large-scale or 3D surfaces. Based on experimental results, the oil separator treated with the fabrication method to create superamphiphilic surfaces showed higher separation efficiency and lower pressure drop compared with a commercial-type oil separator. Hence, it can be seen that this simple, time-saving, and cost-effective method provides a new perspective for the industrial fabrication of superamphiphilic surfaces suited to various environmental conditions.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An Oil separator, comprising:

a housing providing an oil separation space therein;

an inlet introducing oil/gas mixture into the oil separation space and provided within an upper portion of the housing;

an outlet discharging oil and provided within the lower portion of the housing; and a gas discharge conduit connected to the oil separation space, wherein a portion of a surface exposed in the oil separation space is provided with a nanorod layer.

2. The Oil separator of claim 1, wherein the surface provided with the nanorod layer is a surface of steel substrate.

3. The Oil separator of claim 2, wherein the steel substrate is a SS-400 substrate.

4. The Oil separator of claim 1, wherein the nanorod layer is a transition-metal-doped ZnO nanorod layer.

5. The Oil separator of claim 4, wherein the transition-metal-doped ZnO nanorod layer is a Ag-doped ZnO nanorod layer, a Au-doped ZnO nanorod layer, or a Ni-doped ZnO nanorod layer.

6. The Oil separator of claim 4, wherein the transition-metal-doped ZnO nanorod layer has a plurality of nanorods less than about 1.5 μm in length with an average diameter of about 100 to 500 nm.

7. The Oil separator of claim 4, wherein the transition-metal-doped ZnO nanorod layer has a plurality of nanorods, the plurality of nanorods is combined to form a plurality of bundles of nanorods, and the plurality of bundles is arranged so as to expand toward upper direction from the surface.

8. The Oil separator of claim 1, wherein the nanorod layer has superamphiphilic characteristics.

9. The Oil separator of claim 1, wherein the housing has a cylindrical body providing a cylindrical inner wall exposed to the oil separation space, and the nanorod layer is provided on the cylindrical inner wall.

10. The Oil separator of claim 9, the cylindrical body is made of SS-400.

11. The Oil separator of claim 1, wherein the gas discharge conduit extends inside the housing, and a helical-type plate member is provided on the outer surface of the conduit.

12. The Oil separator of claim 11, wherein the nanorod layer is provided on at least one of a surface of the helical type plate member exposed to the oil separation space and an outer surface of the gas discharge conduit exposed to the oil separation space.

13. The Oil separator of claim 12, wherein the helical type plate member and the gas discharge conduit are made of SS-400.

* * * * *